US006017166A

United States Patent [19]

Mossburg, Jr.

[11] Patent Number: 6,017,166

[45] Date of Patent: Jan. 25, 2000

[54] CATCH BASIN GUARD AND FILTER

[76] Inventor: William H. Mossburg, Jr., 308 Carr Ave., Rockville, Md. 20850

[21] Appl. No.: 09/001,033

[22] Filed: Dec. 30, 1997

Related U.S. Application Data

[63] Continuation-in-part of application No. 08/761,609, Dec. 6, 1996, Pat. No. 5,702,595.

[51] Int. Cl.[7] ..... E01C 11/22; E01F 5/00; E03F 5/06

[52] U.S. Cl. ..... 404/5; 404/2; 404/4; 210/163

[58] Field of Search ..... 404/2, 4, 5; 210/163

[56] References Cited

U.S. PATENT DOCUMENTS

| | | | |
|---|---|---|---|
| 232,948 | 5/1880 | Dernham . | |
| 374,393 | 12/1887 | Campbell | 404/4 |
| 468,714 | 2/1892 | Whitten | 404/4 |
| 642,530 | 1/1900 | Robertson | 404/4 |
| 672,868 | 4/1901 | Banwell . | |
| 1,479,651 | 1/1924 | Clements | 404/2 |
| 2,852,369 | 9/1958 | Eyolfson | 210/163 |
| 4,594,157 | 6/1986 | McGowan . | |
| 5,284,580 | 2/1994 | Shyh . | |
| 5,345,741 | 9/1994 | Slater et al. . | |
| 5,375,940 | 12/1994 | Kobayashi | 404/2 |
| 5,702,595 | 12/1997 | Mossburg, Jr. | 210/163 |
| 5,725,782 | 3/1998 | Chinn et al. | 210/767 |
| 5,733,445 | 3/1998 | Fanelli | 210/164 |
| 5,788,849 | 8/1998 | Hutter, Jr. et al. | 210/163 |

FOREIGN PATENT DOCUMENTS

| | | | |
|---|---|---|---|
| 9523B/33 | 6/1979 | German Dem. Rep. . | |
| 1194-984-A | 11/1985 | U.S.S.R. . | |
| 273060 | 6/1927 | United Kingdom . | |
| 454413 | 9/1936 | United Kingdom | 404/4 |

*Primary Examiner*—Thomas B. Will
*Assistant Examiner*—Gary S. Hartmann
*Attorney, Agent, or Firm*—Richard C. Litman

[57] ABSTRACT

A catch basin guard and filter for preventing entry into a catch basin and subsequently a storm drain. The preferred embodiment provides a form fitting cover having a grate. The invention is designed for catch basins being installed in construction sites. The invention blocks the inlet of a catch basin, thereby deterring the entry of debris, animals and, most importantly, children. This deterrent increases the completion of construction because the catch basin will need less cleaning and evacuating before coupling to the existing storm drain system. The invention additionally has a mesh filter covering the grate, and a second embodiment employs overflow apertures to provide for the passing of fluids should the filter become clogged.

13 Claims, 3 Drawing Sheets

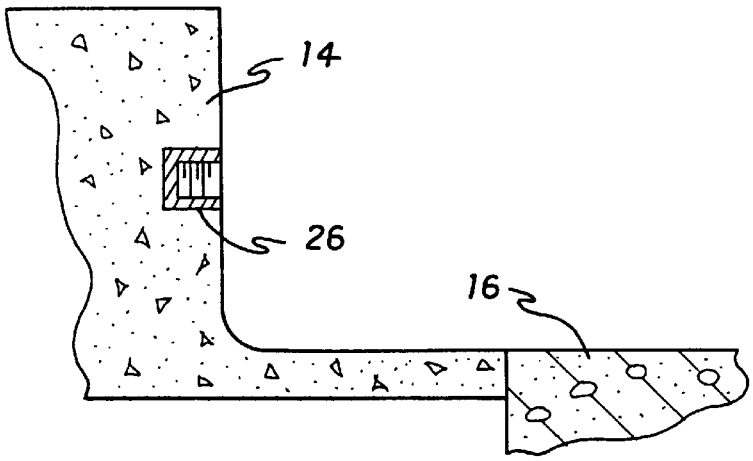
FIG. 2
FIG. 3
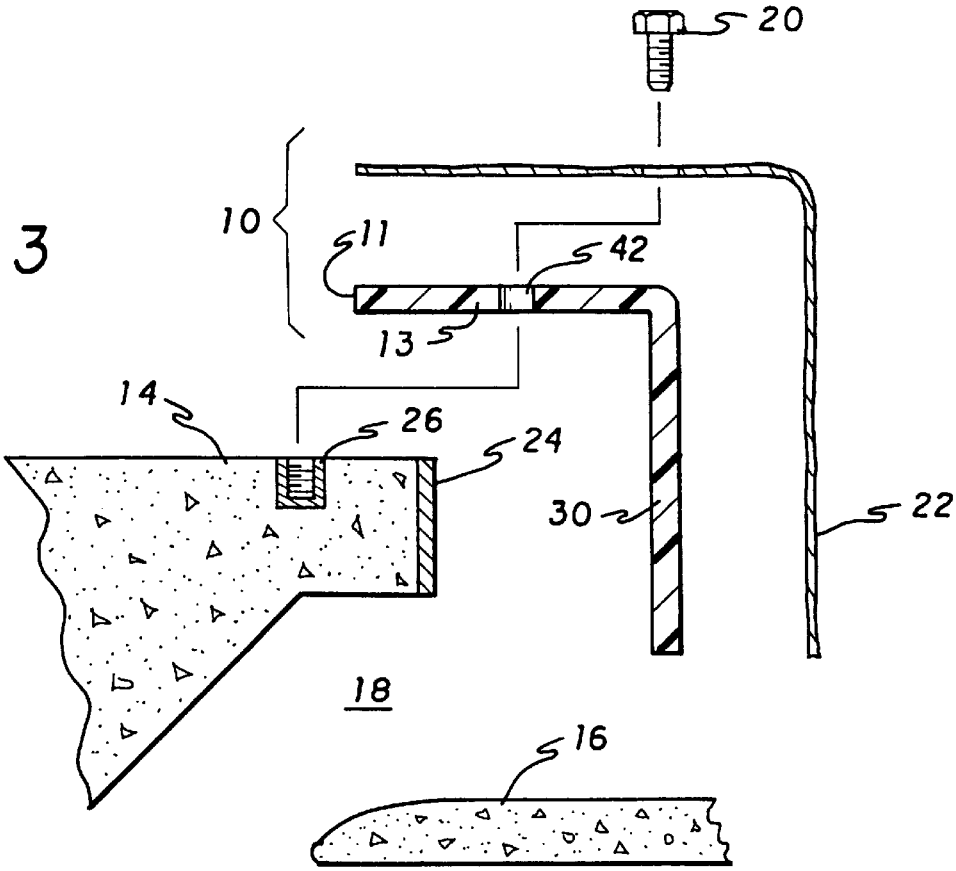

CATCH BASIN GUARD AND FILTER

CROSS-REFERENCE TO RELATED APPLICATIONS

This application is a continuation-in-part of application Ser. No. 08/761,609, filed Dec. 6, 1996. now U.S. Pat. No. 5,702,595.

BACKGROUND OF THE INVENTION

1. Field of the invention

The present invention is a cover for blocking a catch basin, and more particularly a catch basin guard and filter to deter entry of particulate and larger solid materials, animals and children.

2. Description of Related Art

In any sort of construction work in which the earth is disturbed by any great amount, such as excavation for building foundations or altering topological grades, the use of barrier structures is required in most locations by state or local law. In recent years, it has become common to use porous plastic silt barrier sheeting either erected with wooden fence posts or by securing sheeting with rocks or stones over the inlet of a catch basin (also referred to as storm drains and culverts). Although the silt barrier retains the silt and other solid materials (e.g., debris, sticks, etc.), it is unfortunate that the moisture is allowed into the catch basins. This is particularly problematic in new development construction, where the catch basins have not been linked to the existing storm lines. Consequently, fluid buildup in newly installed catch basins must be removed in order to be linked to the existing storm lines.

In new developments, the job of keeping catch basins closed is often subcontracted out and the expense of both covering the catch basin entries and maintaining the same closed is extraordinarily expensive.

In addition to the fluid buildup in the catch basin, other problems such as debris, silt, and stray animals find their way into the catch basins. Even children have either fallen or voluntarily entered into newly placed catch basins presenting even greater problems for construction crews.

Many patents are the subject of preventing silt, debris, and small animals from entering the catch basins. For example, U.S. Pat. No. 5,345,741, issued to Slater et al. on Sep. 13, 1994 discloses a silt collecting attachment for catch basins. Also, U.S. Pat. No. 5,284,580, issued to Shyh on Feb. 8, 1994, discloses a refuse collecting frame positioned beneath the cover of drainage sewers. In the structure taught by either patent, fluid entry into the catch basin will be permitted. Other relevant prior references include U.S. Pat. No. 232,948 issued to Dernham on Oct. 5, 1880; U.S. Pat. No. 672,868 issued to Banwell on Apr. 23, 1901; U.S. Pat. No. 4,594,157 issued to McGowan on Jun. 10, 1986; British Patent No. 273,060 issued to Vose on Jun. 30, 1927; East German Patent No. G9523B/33 issued to Sell et. al. on Jun. 20, 1979 and U.S.S.R. Patent No. SU 1194-984-A issued to Leka on Nov. 30, 1985.

None of the above inventions and patents, taken either singly or in combination, is seen to describe the instant invention as claimed.

SUMMARY OF THE INVENTION

Accordingly, it is a principal object of the invention to provide a barrier for catch basins.

It is another object of the invention to provide a catch basin barrier for deterring the entry of particulate matter, solids, and animals or children into a catch basin.

It is a further object of the invention to provide a removable catch basin barrier allowing access to the catch basin.

It is an important feature of the invention, in particular, to provide a catch basin barrier that will prevent the entry of children into the catch basin through the drain opening.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 2 is a cross-sectional view of an anchor in the curb.

FIG. 3 is an exploded, cross-sectional view of structure for securing the catch basin guard and filter on the catch basin.

Similar reference characters denote corresponding features consistently throughout the attached drawings.

DETAILED DESCRIPTION OF THE PREFERRED EMBODIMENTS

Figure 1:
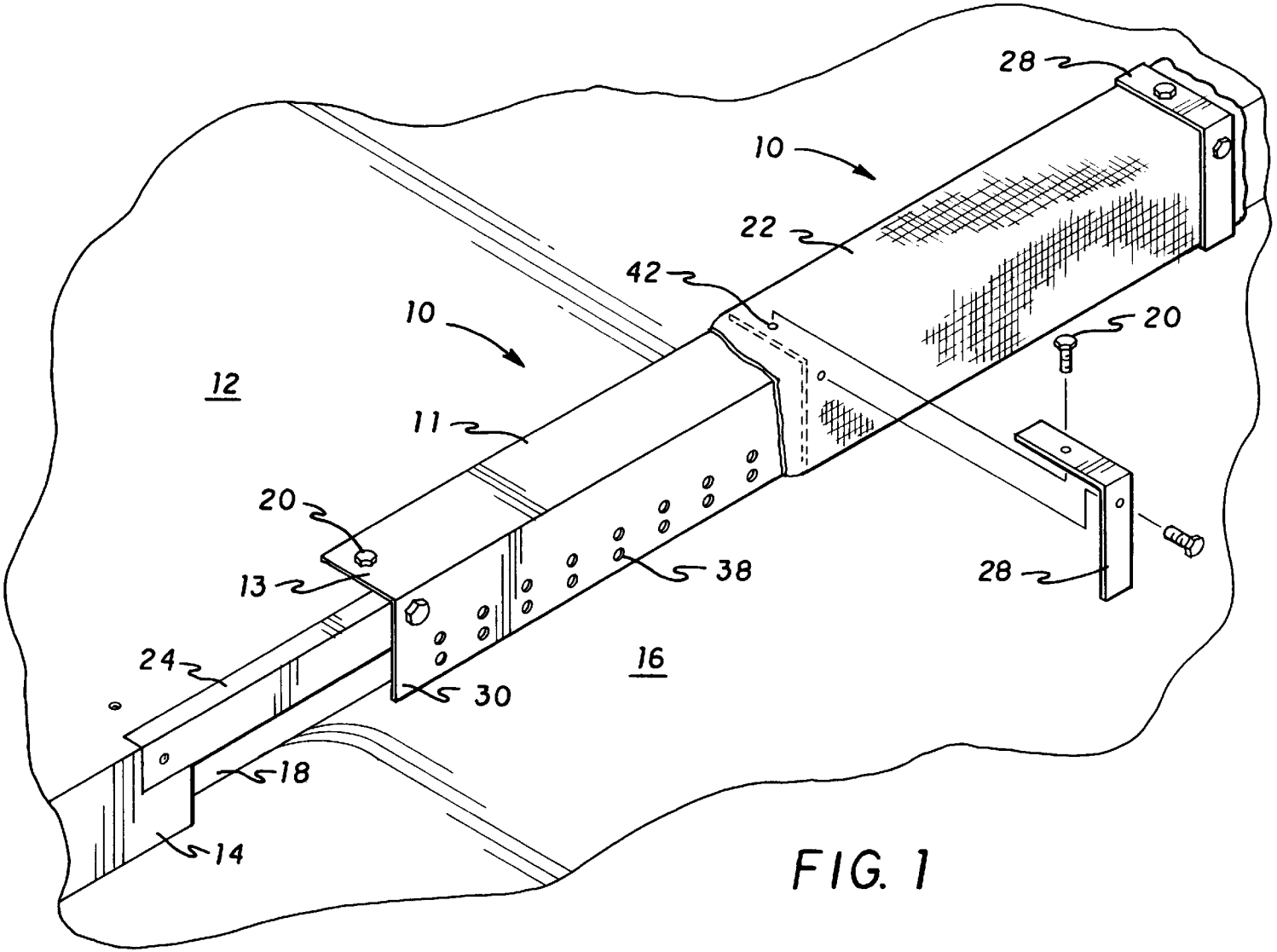
FIG. 1 is an environmental perspective view of a pair of catch basin guard installed on a catch basin, one catch basin guard having a filter installed thereon.

Referring to the drawings wherein like numerals represent like elements, FIG. 1 shows a pair of catch basin guards 10, each having a barrier 11 to cover a catch basin 12. In the preferred embodiment, the barrier 11 is comprised of aluminum, although other suitable material may be used. A typical catch basin 12 has an accessible manhole top (not shown) and an inlet 18. The barrier 11 of the catch basin guard 10 is configured to form fit a standard catch basin 12 and is preferably wider than the inlet 18 of a catch basin 12. Specifically, the inlet 18 is covered by the face 30 of the barrier 11. In the preferred embodiment the barrier has a top portion 13 depending from a face 30 at substantially a 90° angle, whereby the barrier 11 may lay flush against the curb 14.

The barrier 11 is secured to the catch basin 12 by a plurality of bolts 20 coupled to a mating plurality of anchors 26 in the curb 14 through the barrier 11. The bottom edge of the face 30 of the barrier 11 engages the gutter, street, or roadway (shown generally as 16) adjacent to the inlet 18, preventing unwanted solids such as animals or children from entering into the catch basin 12. A grate 38 is present in the face 30 to allow fluids to pass therethrough. A filter sheet 22 is installed over the barrier 11 to prevent particulate matter from entering the catch basin through the grate 38. Additionally, "L"-shaped clips 28 positioned on either side of the barrier 11 secure the sheet 22 to the barrier.

Referring to FIGS. 2 and 3, the barrier 11 of the catch basin guard 10 is secured to the catch basin 12 by bolts 20 along the top portion 13 of the barrier or optionally along the top edge of the face 30 of the barrier. These same bolts 20 additionally secure the clips 28 and filter sheet 22 to the barrier 11. The bolts 20 penetrate through the clips 28, sheet 22 and barrier 11 and mate with corresponding anchors 26. The anchors 26 are either fabricated in the catch basin 12 during manufacturing, or, for existing catch basins, a small bore is made and one of the anchors 26 is seated in a conventional manner.

In areas where the catch basin 12 is adjacent to soft soils and/or descending grades, the anchors 26 may be positioned and secured in the metal plate 24 of the catch basin 12, shown in FIG. 1. Each bolt 20 is positioned in a through-hole 42 present in the sheet 22 clips 28 and barrier 11 and is then threadedly mated with a corresponding anchor 26. Additionally, the filter sheet 22 should be wrapped about the top portion 13 and face 30 and then tucked thereunder to prevent unwanted particulate matter from entering the catch basin 12 from the top and bottom edges of the barrier 11.

When working with particularly wide catch basins 12, it may be necessary to use more than one catch basin guard 10. In this instance, as shown in FIG. 1, the edge of one barrier 11 is placed over the edge of another barrier 11, whereby the respective through-holes 42 of each barrier are aligned in registry, thereby preventing the entry of particulate matter and larger solids.

Figure 4:
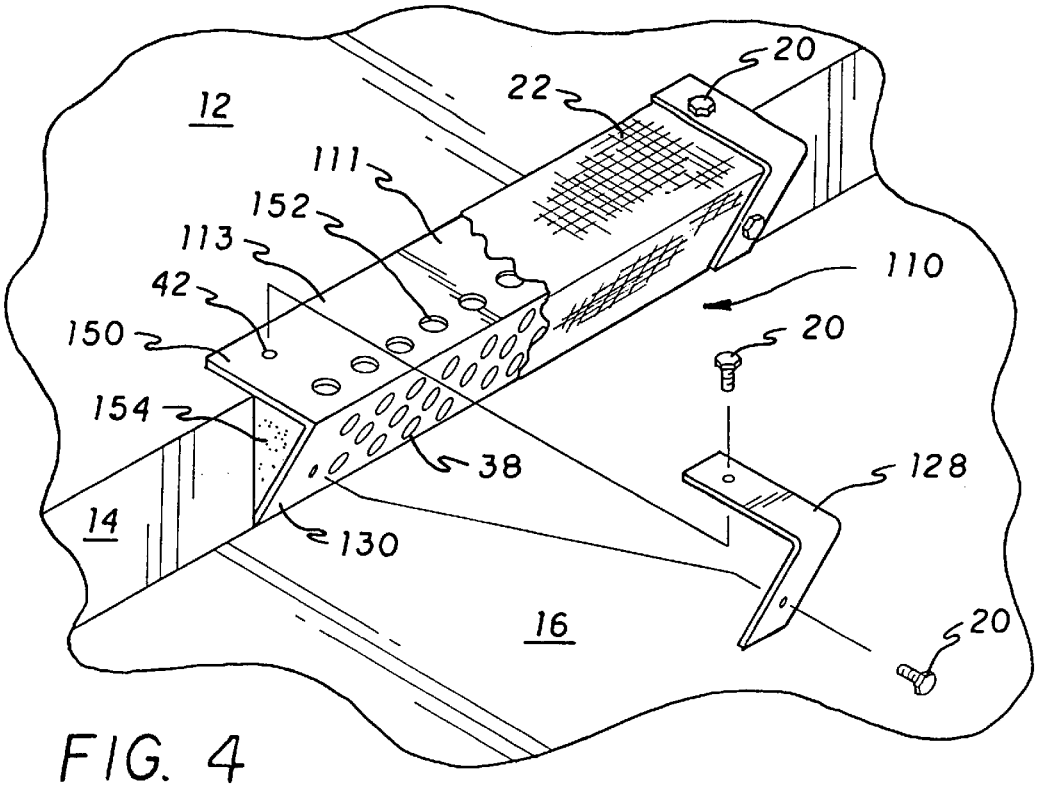
FIG. 4 is an environmental perspective view of an alternative embodiment of the present invention.

Referring to FIG. 4, a second embodiment of the catch basin guard 110 is shown. While the top portion 13 and the face 30 of the first embodiment are at a 90° angle, the top portion 113 and the face 130 of the second embodiment are at an acute angle. A ridge 150 slightly extends beyond the curb 14 toward the road 16, tilting the face 130 slightly downward and toward the road. A plurality of overflow apertures 152 are present along the ridge 150 that allow fluid to enter a barrier 111, should the filter sheet 22 become clogged with particulate matter.

Additionally, the barrier 111 of the second embodiment has pair of end caps 154, each end cap mounted on a respective end of the barrier. The end caps 154 function to prevent entry of debris and fluid through the sides of the barrier 111. The edges of the barrier ideally extend a minimum of two inches beyond the end caps 154, in order for multiple catch basin guards 110 to be used in conjunction with a single catch basin 12. The through-holes 42 are preferably located in the portion of the barrier 111 that extends beyond the end caps 154, and "7"-shaped clips 128 are used to secure the filter 22 to the barrier. The barrier 111, filter sheet 22 and clips 128 are all secured the same way they are secured in the first embodiment of the invention 10.

Figure 5:
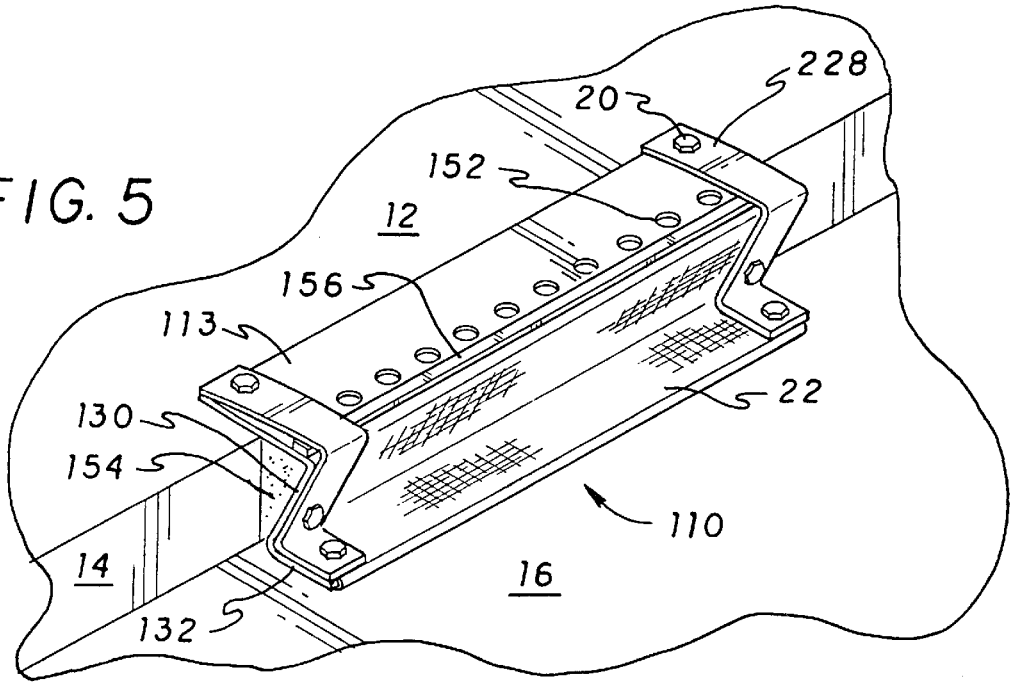
FIG. 5 is an environmental perspective view of yet a further alternative embodiment of the invention.

Should the user desire the overflow apertures 152 to remain unobstructed by the filter sheet 22, the user may affix a retaining bar 156 to the ridge 150, as shown in FIG. 5. The retaining bar 156 is placed over the filter sheet 22 and proximate to the intersection of the ridge 150 and face 130 and is affixed thereto by securing a clip 128 over each end of the retaining bar, and threadedly mating a bolt 20 through a respective through-hole 42 of each clip and then through a respective through-hole of the barrier 111, mating each bolt with a corresponding anchor 26.

Also as shown in FIG. 5, the face 130 of the barrier 11, 111 may also have a lower extension 132 depending from the bottom edge thereof outwardly over the roadway 16. The extension 132 performs the same non-ingression function as the face 30, 130 of the barrier 11 when the catch basin 12 has an inlet in the surface of the roadway 16. The lower extension 132 is secured to the roadway 16 in like manner as the face 30, 130 and the top portion 13 of the barrier 11, via a plurality of bolts 20 which pass through-holes 42 and subsequently mate with anchors 26 seated in the roadway 16 surface. It will be readily appreciable by those skilled in the art that the lower extension 132 shown in the second embodiment of the invention 110 may also be employed in the first embodiment of the invention 10. Also, those skilled in the art will appreciate that in order to maintain the filter sheet 22 flush against the lower extension 132, "Z"-shaped clips 228 may be employed, as shown in FIG. 5.

The catch basin guard 10, 110 of the present invention provides a necessary and extra amount of prevention of dangerous construction runoff. Also, the catch basin guard 10, 110 of the present invention protects the environment. Most importantly, the invention 10, 110 protects the safety and lives of small children.

The first purpose of the present invention is satisfied because the catch basin guard 10, 110 is impervious to solids, animals and children; thus when a catch basin 12 is installed in a new construction site, the catch basin guard 10, 110 prevents the catch basin 12 from being entered by children or animals. It is a most significant feature of the invention that the catch basin guard 10, 110, in any circumstance, prevents mischievous children from accidentally or intentionally entering the catch basin 12, endangering their safety or even their lives.

The filter sheet 22 present over the grate 38 prevents particulate matter from entering and clogging the catch basin 12. Should there be imperfections in the curb 14 where the catch basin guard 10, 110 engages the curb, the user may use caulking (not shown) to ensure that there is a watertight seal surrounding the catch basin guard. Additional protection of construction workers is encompassed by the catch basin guard 10, 110 because disease carrying rodents are prevented from nesting in a catch basin before it has been permanently installed into the drain system.

It is to be understood that the present invention is not limited to the embodiments described above, but encompasses any and all embodiments within the scope of the following claims.

I claim:

1. A catch basin face cover for preventing unwanted entry into a catch basin of a curb, the catch basin having a curb wall with an upper portion and a lower portion offset in substantially parallel planes from one another and defining a drain entry therebetween, said catch basin face cover comprising:

a planar form dimensioned to cover the drain entry, said planar form including a grate to provide for the passage of fluids;

a filter sheet dimensioned to cover said planar form;

a plurality of clips positioned over said filter sheet, each of said clips including at least one throughbore;

a plurality of securing means and a plurality of through bores in said planar form for attaching said planar form to the curb wall, said securing means also for attaching said plurality of clips over said filter sheet, thereby securing said filter sheet to said planar form; and a plurality of anchoring means for respectively receiving each one of said plurality of securing means, each of said plurality of securing means positioned in the curb wall;

whereby said planar form covers the catch basin drain entry and said securing means coupled to said anchoring means holds said form over the drain entry.

2. The catch basin face cover for preventing unwanted entry into a catch basin according to claim 1, wherein said planar form is fabricated from aluminum.

3. The catch basin face cover for preventing unwanted entry into a catch basin according to claim 1, wherein said filter sheet is made of material selected from the group consisting of nylon, cloth, metal and plastic.

4. The catch basin face cover for preventing unwanted entry into a catch basin according to claim 1, further including a first extension of said planar form, said first extension depending from said planar form at a substantially right angle forming an "L" configuration, whereby said first extension rests upon the upper portion of the curb wall and said planar form covers the drain entry, and said filter sheet wraps about said planar form and said first extension.

5. The catch basin face cover for preventing unwanted entry into a catch basin according to claim 4, wherein said planar form and said extension are fabricated from aluminum.

6. The catch basin face cover for preventing unwanted entry into a catch basin according to claim 4, wherein said first extension defines a plurality of first extension throughbores, there further being a plurality of securing means for attaching said first extension to the curb wall, each of said plurality of securing means positioned in a different one of said plurality of first extension throughbores, and a plurality of anchoring means for respectively receiving each one of said plurality of securing means, each of said plurality of securing means positioned in the curb wall and coupled to a different one of said plurality of anchoring means.

7. The catch basin face cover for preventing unwanted entry into a catch basin according to claim 4, further including a second extension depending from said planar form at a substantially right angle forming a "Z" configuration, wherein said second extension defines a plurality of second extension throughbores, and further including a plurality of securing means for attaching said second extension to the curb wall, each of said plurality of securing means positioned in a different one of said plurality of second extension throughbores, and a plurality of anchoring means for respectively receiving each one of said plurality of securing means, each of said plurality of securing means positioned in the curb wall and coupled to a different one of said plurality of anchoring means, whereby said second extension rests upon the lower portion of the curb wall and said planar portion covers the drain entry, and said filter sheet wraps about said planar form, said first extension and said second extension.

8. A catch basin face cover for preventing unwanted entry into a catch basin of a curb, the catch basin having a curb wall with an upper portion and a lower portion offset in substantially parallel planes from one another and defining a drain entry therebetween, said catch basin face cover comprising:

a planar form having a plurality of throughbores, said planar form dimensioned to cover the drain entry;

a grate present in said planar form for permitting fluid entry into the catch basin through said planar form;

a first extension of said planar form and a second extension of said planar form, said first extension and said second extension depending from said planar form at substantially right angles forming an "Z" configuration;

wherein said planar form, said first extension and said second extension are fabricated from aluminum;

a plurality of securing means for attaching said planar form to the curb wall, each of said plurality of securing means being positioned in a different one of said plurality of throughbores; and a plurality of anchoring means for respectively receiving each one of said plurality of securing means, each of said plurality of securing means positioned in the curb wall;

wherein said first extension rests upon the upper portion of the curb wall, the second extension rests upon the lower portion of the curb wall and said planar form covers the drain entry.

9. The catch basin face cover for preventing unwanted entry into a catch basin according to claim 8, wherein said first extension defines a plurality of first extension throughbores, and further including a plurality of securing means for attaching said first extension to the curb wall, each of said plurality of securing means positioned in a different one of said plurality of first extension throughbores, and a plurality of anchoring means for respectively receiving each one of said plurality of securing means, each of said plurality of securing means positioned in the curb wall and coupled to a different one of said plurality of anchoring means.

10. The catch basin face cover for preventing unwanted entry into a catch basin according to claim 8, wherein said second extension defines a plurality of second extension throughbores, and further including a plurality of securing means for attaching said second extension to the curb wall, each of said plurality of securing means positioned in a different one of said plurality of second extension throughbores, and a plurality of anchoring means for respectively receiving each one of said plurality of securing means, each of said plurality of securing means positioned in the curb wall and coupled to a different one of said plurality of anchoring means, whereby said second extension rests upon the lower portion of the curb wall and said planar portion covers the drain entry.

11. A catch basin face cover for preventing unwanted entry into a catch basin of a curb, the catch basin having a curb wall with an upper portion and a lower portion offset in substantially parallel planes from one another and defining a drain entry therebetween, said catch basin face cover comprising:

a planar form having opposed ends, and dimensioned to cover the drain entry;

a grate present in said planar form for permitting fluid entry into the catch basin through said planar form;

a first extension of said planar form and, said first extension having opposed ends and depending from said planar form at an acute angle forming a "7" configuration, said first extension having a ridge extending over the drain entry, said ridge further having a plurality of overflow apertures;

a pair of edge portions, a said edge portion present on a respective said end of said planar form and present on a respective said end of said first extension;

a pair of end caps, each end cap mounted proximate to each said edge portion, each said edge portion extending a predetermined distance beyond each said end cap;

a filter sheet dimensioned to cover said planar form and said first extension, said filter sheet wrapped about said planar form and said first extension;

a plurality of clips positioned over said filter sheet;

wherein said planar form and said first extension are comprised of aluminum;

a plurality of throughbores present in each said edge portion of said planar form;

a plurality of securing means for attaching said planar form to the curb wall, and for attaching said plurality of clips over said filter sheet, thereby securing said filter sheet to said edge portions of said planar form and said first extension, each of said plurality of securing means positioned in a different one of said plurality of throughbores; and a plurality of anchoring means for respectively receiving each one of said plurality of securing means, each of said plurality of securing means positioned in the curb wall and coupled to a different one of said plurality of anchoring means;

whereby said first extension rests upon the upper portion of the curb wall and said planar form covers the drain entry.

12. The catch basin face cover for preventing unwanted entry into a catch basin according to claim 11, further including a retaining bar mounted along said ridge intermediate said edge portions, said retaining bar securing said filter sheet to said ridge, wherein said filter sheet covers said planar form.

13. The catch basin face cover for preventing unwanted entry into a catch basin according to claim 11, further including an aluminum second extension depending from said planar form at an acute angle forming a "Z" configuration, wherein said second extension defines a plurality of second extension throughbores, and further including a plurality of securing means for attaching said second extension to the curb wall, each of said plurality of securing means positioned in a different one of said plurality of second extension throughbores, and a plurality of anchoring means for respectively receiving each one of said plurality of securing means, each of said plurality of securing means positioned in the curb wall and coupled to a different one of said plurality of anchoring means, whereby said second extension rests upon the lower portion of the curb wall and said planar portion covers the drain entry.

* * * * *